US006249260B1

(12) United States Patent
Holloway

(10) Patent No.: US 6,249,260 B1
(45) Date of Patent: Jun. 19, 2001

(54) T-TOP ANTENNA FOR OMNI-DIRECTIONAL HORIZONTALLY-POLARIZED OPERATION

(75) Inventor: David J. Holloway, Anaheim, CA (US)

(73) Assignee: Comant Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 09/356,073

(22) Filed: Jul. 16, 1999

(51) Int. Cl.[7] ..... H01Q 1/38
(52) U.S. Cl. ..... 343/795; 343/818; 343/835
(58) Field of Search ..... 343/793, 795, 343/700 MS, 806, 810, 818, 817, 819, 833, 834, 835, 893

(56) References Cited

U.S. PATENT DOCUMENTS

| | | | | |
|---|---|---|---|---|
| 2,700,104 | | 1/1955 | Bowman | 250/33 |
| 2,968,038 | | 1/1961 | Hauptschein | 343/709 |
| 3,604,006 | | 9/1971 | Rogers | 343/705 |
| 3,739,390 | | 6/1973 | Poppe, Jr. et al. | 343/729 |
| 3,945,013 | | 3/1976 | Brunner et al. | 343/708 |
| 4,008,479 | | 2/1977 | Smith | 343/895 |
| 4,072,952 | | 2/1978 | Demko | 343/700 MS |
| 4,083,050 | | 4/1978 | Hall | 343/729 |
| 4,084,162 | | 4/1978 | Dubost et al. | 343/700 MS |
| 4,160,977 | | 7/1979 | Davis | 343/713 |
| 4,329,690 | | 5/1982 | Parker | 343/709 |
| 4,331,961 | | 5/1982 | Davis | 343/704 |
| 4,392,139 | | 7/1983 | Aoyama et al. | 343/705 |
| 4,438,437 | | 3/1984 | Burgmyer | 343/770 |
| 4,573,056 | * | 2/1986 | DuDome et al. | 343/795 |
| 4,635,066 | | 1/1987 | St. Clair et al. | 343/705 |
| 4,686,536 | * | 8/1987 | Allcock | 343/795 |
| 4,825,220 | | 4/1989 | Edward et al. | 343/795 |
| 4,847,626 | * | 7/1989 | Kahler et al. | 343/700 MS |
| 4,868,577 | | 9/1989 | Wingard | 343/713 |
| 4,870,426 | | 9/1989 | Lamberty et al. | 343/727 |
| 5,021,799 | | 6/1991 | Kobus et al. | 343/795 |
| 5,148,183 | | 9/1992 | Aldama | 343/853 |
| 5,191,352 | | 3/1993 | Branson | 343/895 |
| 5,198,826 | | 3/1993 | Ito | 343/726 |
| 5,272,485 | | 12/1993 | Mason et al. | 343/700 MS |
| 5,300,936 | | 4/1994 | Izadian | 343/700 MS |
| 5,313,218 | | 5/1994 | Busking | 343/727 |
| 5,489,912 | | 2/1996 | Holloway | 343/749 |
| 5,495,260 | | 2/1996 | Couture | 343/795 |
| 5,532,708 | | 7/1996 | Krenz et al. | 343/795 |
| 5,572,226 | | 11/1996 | Tuttle | 343/726 |
| 5,610,620 | | 3/1997 | Stites et al. | 343/725 |
| 5,614,917 | | 3/1997 | Kennedy et al. | 343/846 |
| 5,621,420 | | 4/1997 | Benson | 343/791 |
| 5,838,285 | * | 11/1998 | Tay et al. | 343/700 MS |
| 5,892,486 | * | 4/1999 | Cook et al. | 343/795 |
| 5,999,141 | * | 12/1999 | Weldon | 343/817 |

* cited by examiner

*Primary Examiner*—Hoanganh Le
*Assistant Examiner*—Thuy Vinh Tran
(74) *Attorney, Agent, or Firm*—Lee Stanger

(57) ABSTRACT

An antenna array includes two acutely bent dipole antenna elements placed back-to-back on a printed circuit board with integrated micro-strip balun transformers which a Wilkinson divider drives 180 degrees out of phase. In an embodiment, the antenna array sits on a vertical blade support structure to form a T-Top section.

26 Claims, 3 Drawing Sheets

T-TOP ANTENNA FOR OMNI-DIRECTIONAL HORIZONTALLY-POLARIZED OPERATION

FIELD OF THE INVENTION

This invention relates to antennas of the T-Top type, particularly for achieving omni-directional horizontally-polarized operation.

BACKGROUND OF THE INVENTION

Both monopole and T-Top antennas have been used in aircraft for some time. T-Top antennas generate a radiation pattern of a natural elliptical shape and are limited in capacity for omni-directional horizontally-polarized operation.

SUMMARY OF EMBODIMENTS OF THE INVENTION

According to an embodiment of the invention, an antenna array in an elliptical T-Top section sits on a vertical blade support structure, and includes two bent dipole antenna elements which appear back to back on a printed circuit board with fully integrated micro-strip balun transformers.

According to an embodiment two very short director structures extending between opposite tips of opposite dipoles shape the radiation pattern and force it more circular from its more natural elliptical shape.

According to another embodiment, a Wilkinson divider drives the baluns 180 degrees out of phase. A single connector feeds the Wilkinson divider.

The various features that characterize the invention are pointed out in the claims forming a part of this specification. The various advantages, benefits, and enhancements will become apparent with the following detailed description of exemplary embodiments when taken in view of the appended drawings.

DETAILED DESCRIPTION OF PREFERRED EMBODIMENTS

Figure 1:
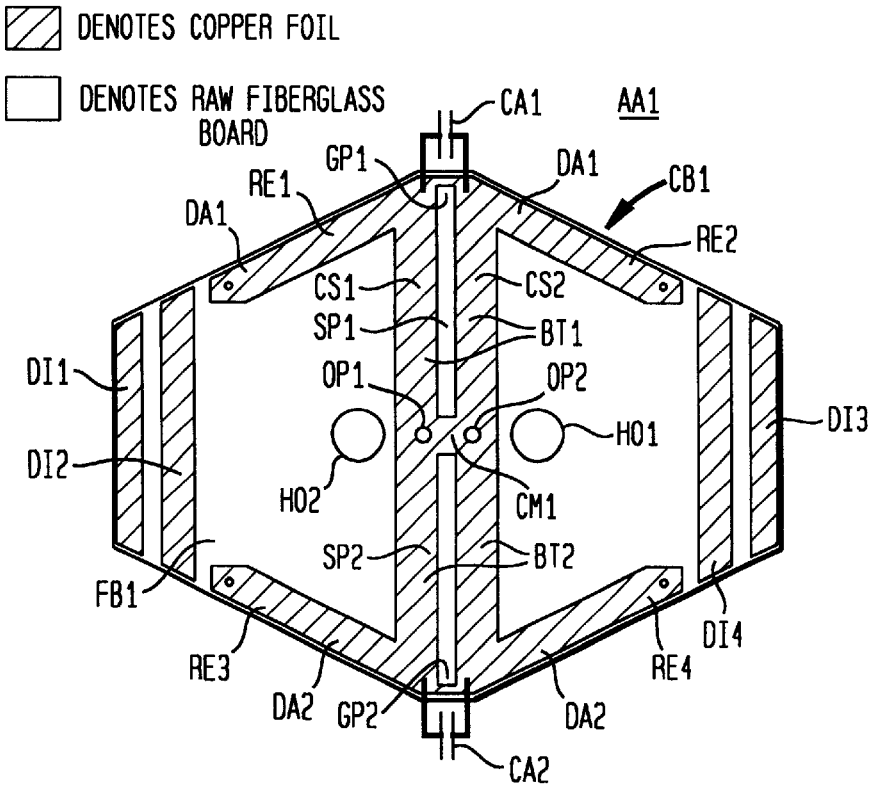
FIG. 1 is a partially schematic view of an antenna array, including a bottom view of a circuit board embodying the invention.

In FIG. 1, an antenna array AA1 includes a circuit board CB1 with a fiberglass board FB1 supporting two copper-foil arrow-shaped back-to-back dipole antennas DA1 and DA2. The dipole antenna DA1 includes two mutually-angular radiator elements RE1 and RE2 and the dipole antenna DA2 includes two mutually-angular radiator elements RE3 and RE4. The radiator elements RE1 and RE2 of the dipole antenna DA1 and radiator elements RE3 and RE4 of the dipole antenna DA2 form respective arrowhead shapes directed away from each other. A gap GP1 separates the radiator elements RE1 and RE2 while a gap GP2 separates the radiator elements RE3 and RE4. A high-Q ceramic chip capacitor CA1 between the elements RE1 and RE2 tunes the dipole antenna DA1, and a second high-Q ceramic chip capacitor CA2 between the elements RC3 and RE4 tunes the dipole antenna DA2. Mutually-separated conductive directors DI1 and DI2 are spaced from, but span, the ends of the radiator elements RE1 and RE3, while mutually-separated conductive directors DI3 and DI4 are spaced from, but span, the ends of radiator elements RE2 and RE4. Central conductive copper foil stems (or legs) CS1 and CS2 and a copper foil cross member CM1 form an H-shaped structure with spaces SP1 and SP2. The stem CS1 extends from radiator RE1 to radiator RE3 while the stem CS1 extends between radiators RE2 and RE4. The stems CS1 and CS2 constitute inductive paths at the operating frequencies of the array AA1. Openings OP1 and OP2 in the metal at the cross member CM1 allow passage of conductors through the metal and the fiberglass board FB1 without contacting the metal of cross member CM1.

Figure 2:
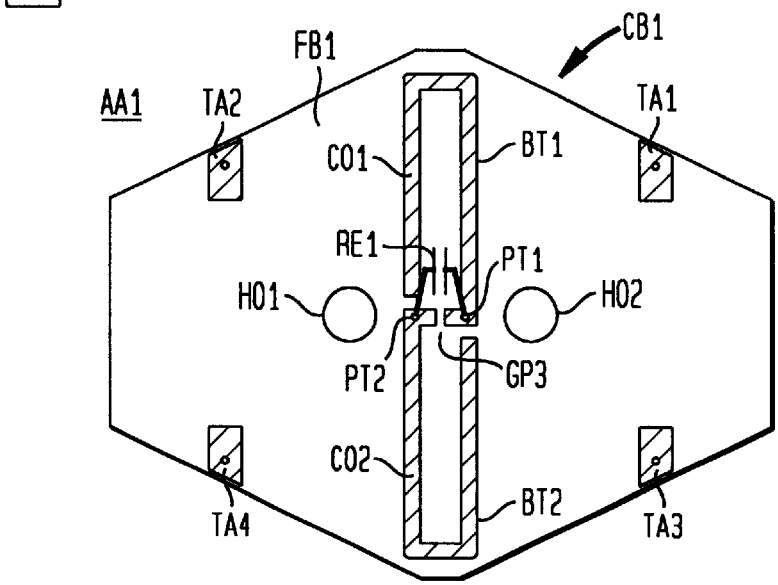
FIG. 2 is a top view of FIG. 1.

FIG. 2 shows the top view of the array in FIG. 1. Here, a gap GP3 isolates two copper-foil U-shaped conductors CO1 and CO2 located opposite the central stems CS1 and CS2 of the dipoles DA1 and DA2. A resistor RE1 connects points PT1 and PT2 on the conductors CO1 and CO2. The points PT1 and PT2 are aligned with the centers of the openings OP1 and OP2. The conductors CO1 and CO2 form balun transformers BA1 and BA2 with the stems CS1 and CS2. The conductors CO1 and CO2 follow opposing clockwise and counterclockwise paths to produce 180 degree relative phase reversal during operation of the balun transformers BA1 and BA2. Such phase reversal helps generate an omni-directional radiation pattern. Tabs TA1 and TA2 connect through the fiberglass board FB1 to the ends of the respective radiator elements RE1 and RE2 of the dipole antenna DA1, and conductive tabs TA3 and TA4, connected through the fiberglass board FB1 to the ends of the radiation elements RE3 and RE4 of the dipole antenna DA2. The tabs TA1 and TA2 help shape the radiation pattern and can be adjusted for tuning. Through holes HO1 and HO2 in the fiberglass board allow passage of foam to lock the circuit board CB1 in place. The alignment of the points PT1 and PT2 with the centers of openings OP1 and OP2 allows conductors to pass through the openings and the fiberglass board FB1 to connect to the points.

Figure 3:
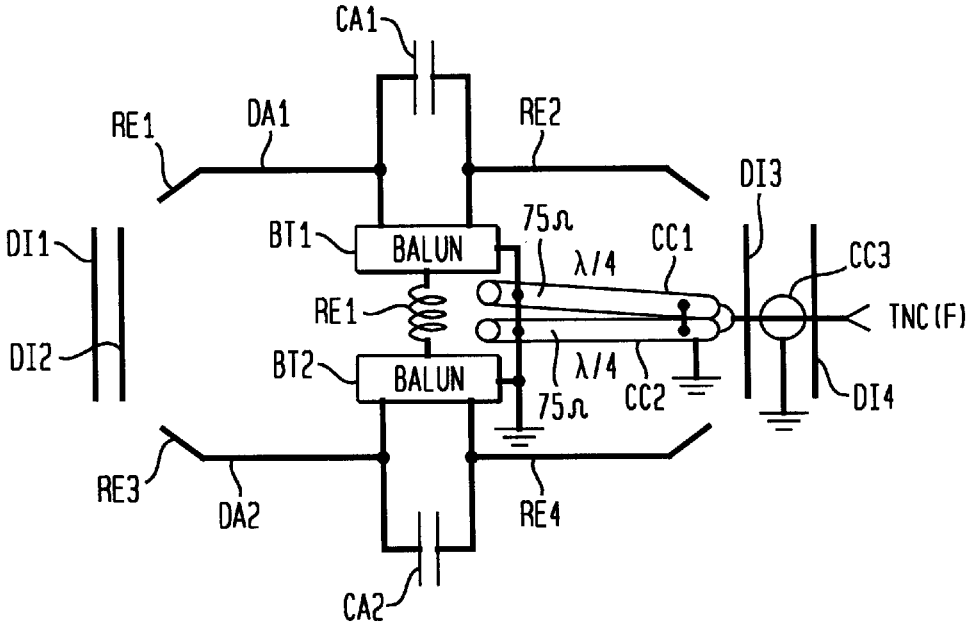
FIG. 3 is a schematic diagram illustrating an antenna embodying the invention and including the array of FIGS. 1 and 2 and showing the connections to a feed allay.

FIG. 3 is a schematic diagram illustrating the circuitry of the antenna array AA1 in FIGS. 1 and 2. Here, the resistor RE1 connects the balun transformers BT1 and BT2 between points PT1 and PT2 in FIG. 2. According to one embodiment of the invention the resistor RE1 is 100 ohms. However other values may be used and are contemplated. Two quarter-wave 75-ohm coaxial cables CC1 and CC2 have central conductors which connect to points PT1 and PT2 across the 100-ohm resistor RE1 to form a Wilkinson divider that connects at one end to a single TNC(F) connector. The central conductors of the coaxial cables CC1 and CC2 pass through the openings OP1 and OP2 as well as through the fiberglass board FB1, without touching the metal at the cross member CM1 in FIGS. 1 and 2. The shields of the cables CC1 and CC2 connect to the metal at the cross member CM1. The cables CC1 and CC2 join to form a common shielded cable CC3.

At the operating frequency of the system, the stems CS1 and CS2 form inductive connections from the radiator elements RE1 to RE 4 to the central member CM1. The latter forms a ground plane which the outer shields of cables CC1 and CC2 connect to other grounds. The capacitors CA1 and CA2 are ceramic chip capacitors connected across the balun transformers BT1 and BT2. The spacings across the gaps GP1 and GP2 have capacitive effects which add to the capacitances of the chip capacitors CA1 and CA2.

When both dipoles DA1 and DA2 transmit or receive radiation, no current flows through the 100-ohm resistor RE1. The directors DI1, DI2, and DI3, DI4 force the usual elliptical radiation pattern toward a more circular shape. Moreover, the dipole radiator elements in FIGS. 1 and 2 are angled inwardly to promote a more circular radiation pattern. The balun transformers BT1 and BT2 are of the micro-strip type and are physically arranged on the printed circuit board to cause 180 degree relative phase reversal when driven by the Wilkinson divider.

Figure 4:
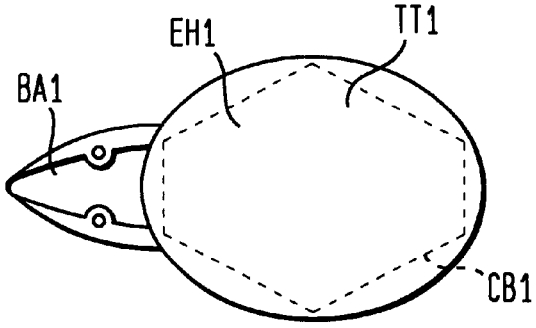
FIG. 4 is a top view of an antenna embodying the invention and including the array of FIGS. 1 to 3.
Figure 5:
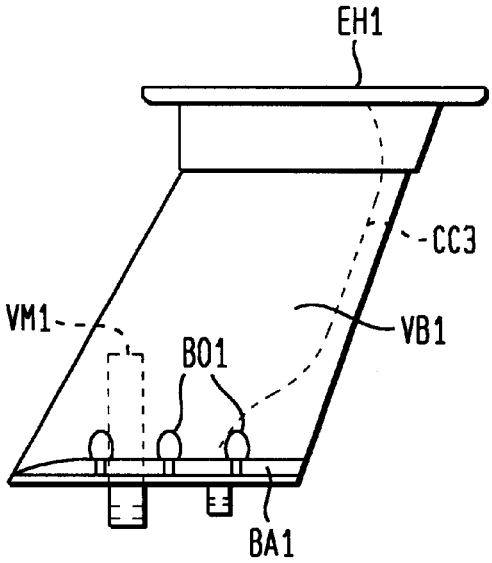
FIG. 5 is side view of the antenna in FIG. 4.
Figure 6:
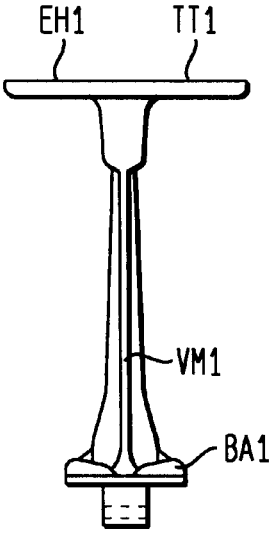
FIG. 6 is an elevation of the antenna in FIG. 5.
Figure 7:
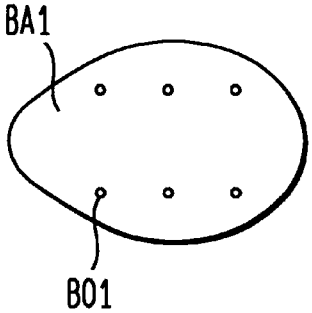
FIG. 7 is a detailed view of the base of the antenna in FIGS. 4, 5 and 6.

FIGS. 4, 5 and 6 illustrate the support for the T-Top antenna array AA1 of FIGS. 1 to 3. Here, an elliptical housing EH1, which surrounds the array AA1 with the circuit board CB1 as well as the resistor RE1, sits on top of a vertical blade VB1 that supports the T-Top TT1. Suitable bolts BO1 support a base BA1 of the blade VB1 on a section of an aircraft as shown in FIGS. 5 and 7. According to other embodiments arrangements other than a base with bolts support the blade VB1. Also, other forms of connectors and cable values serve in other embodiments. According to the embodiment shown, the long dimension of the circuit board CB1 extends along the longer axis of the eliptical housing EH1. The alignment my be otherwise in other embodiments.

Figure 8:
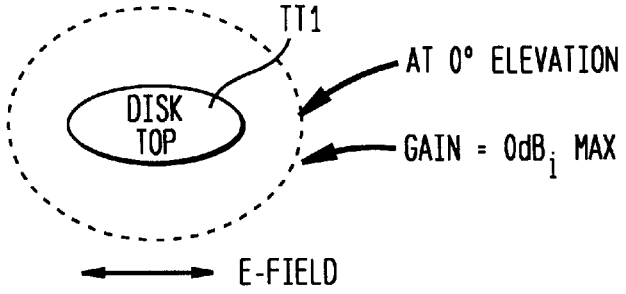
FIG. 8 is a diagram illustrating the T-Top radiation pattern in the azimuthal plane looking down on top of the elliptical disk in the T-Top of the antenna in FIGS. 4 to 7.
Figure 9:
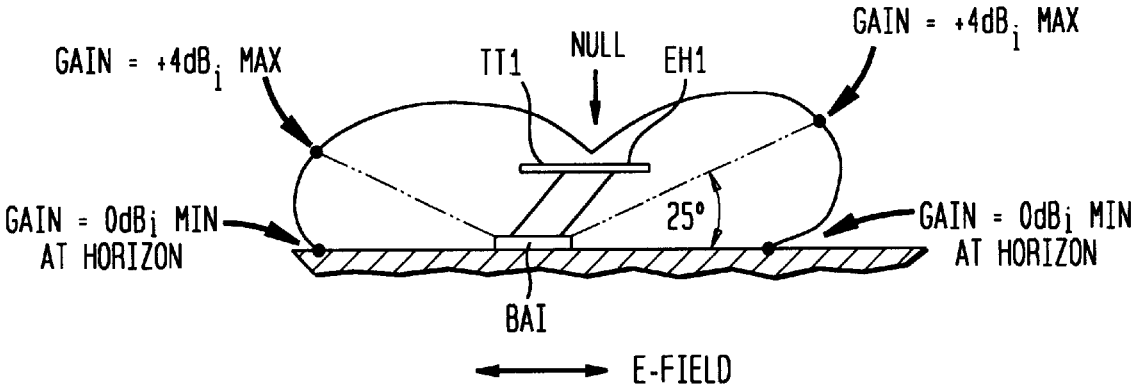
FIG. 9 is a diagram of the radiation patterns in the elevational plane of the antenna in FIGS. 1 to 7.

A vertical monopole VM1 passes vertically through the vertical blade at the front (left in FIG. 5) to furnish vertically polarized coverage along with regular vertically polarized transponder operation. The vertical monopole VM1 is of the wide-band type connected to a type N(F) connector to provide operation in two UHF frequency bands. The monopole VM1 may be any of several conventional types, for example a conventional folded type with an embedded quarter-wave stub for broadening the antenna's coverage to span the two frequency bands. The frequency bands may, for example, be 824–894 MHz and 1030–1090 MHz although other ranges are possible. Sufficient space separates the flexible coaxial feed cable (at the rear, to the right in FIG. 5) including the quarter-wave 75-ohm coaxial cables of the Wilkinson divider, and the TNC(F) cable from the vertical monopole VM1 to preserve the monopole's broad-band characteristics and minimize mutual coupling between the coaxial cables and the monopole. According to an embodiment In operation of an embodiment shown, the array of FIGS. 1 to 3 in a structure in FIGS. 4 to 8, with the shields of the cables CA1 and CA2 connecting the ground plane at the metal of the member CM1 to the metal of the aircraft, produces a radiation pattern of the type illustrated in FIGS. 8 and 9. Specifically, FIG. 8 illustrates a sample radiation pattern in the azimuthal plane (looking down on top of the elliptical disk), namely in the YAW plane. At 0 elevation, there is a gain of 0 $dB_i$ at a minimum. The E field extends horizontally. As shown in FIG. 9, in the elevation plane looking from front to back or each side, namely the roll/pitch planes, a null appears directly above the T-Top and lobes appear on each side of the radiation pattern. As an example, a gain at 25 degrees above the metal frame of the aircraft is equal to +4 $dB_i$ maximum while a gain closer to zero is equal to 0 $dB_i$ minimum. The E field extends horizontally.

The bottom of the circuit board CB1 faces downward in the T-Top TT1 as shown in FIGS. 5 and 6. This allows easy access for the shields of the cables CC1 and CC2 to the cross member CM1 which forms the ground plane of the circuit board CB1. The shields of the cable CC1 and CC2 are grounded through the shield of the common cable CC3 to the aircraft.

The bending of the dipoles DA1 and DA2 fill in nulls in front and back of the radiation pattern. The directors DI1 and DI2 as well as DI3 and DI4 have approximate lengths $\lambda/4$ where $\lambda$ is the operating wavelength at the center of the band and serve to reradiate energy and help produce a round radiation pattern. The directors DI1 and DI2 as well as DI3 and DI4 are located at a fraction of $\lambda/4$ from the radiators RA1, RA2, RA3, and RA4, close enough to operate in the near field. According to an embodiment the radiators RA1, RA2, RA3, and RA4 are trimmed to help achieve the desired radiation pattern. The tabs TA1, TA2, TA3, and TA4 may also be trimmed to assist in producing a desired pattern. Once a particular result is established, the particular structure is maintained in other arrays.

The disclosed embodiments form circuit-board-mounted dipole antennas bent backwards toward each other and grounded at CM1 through inductive legs (the stems CS1 and CS2). The latter form fully integrated, 180 degree out of phase, balun transformers with mutually-isolated U-shaped conductors CO1 and CO2 on the opposite side of the circuit board CB1. The conductors CO1 and CO2 follow opposing paths to achieve the phase reversal when driven by a Wilkinson divider. The bent dipole antennas DA1 and DA2 combine with the quarter wave directors DI1 to DI4 (which are very short and) disposed very close to the tips of the opposing dipoles at the near field of the dipole antennas, and with the tabs TA1 to TA4 as well as the capacitors CA1 and CA2, to achieve omnidirectiolal radiation in a T-Top antenna. According to embodiments of the invention, the tabs TA1 to TA4 and the directors DI1 to DI4 are adjusted by removal of material to establish a desired omnidirectional radiation pattern. According to an embodiment, once a particular configuration is established for a desired radiation pattern, the configuration is repeated. A single CC3 feeds the array through the Wilkinson divider.

While various embodiments have been described in detail, it will be understood that other and further modifications can be made to the herein disclosed embodiments without departing from the spirit and scope of the present invention. For example the 75 ohm cables are replaced by other values in other embodiments of the invention. Also, according to an embodiment, the array of FIGS. 1 to 3 is used in supports that differ from the supports in FIGS. 4 to 7, both with and without the vertical monopole.

What is claimed is:

1. An antenna structure, comprising:

a dielectric board having two faces;

two bent dipole antennas placed back-to-back on one face of said dielectric board;

two balun transformers on the faces of said board each connected to one of said dipole antennas, and in 180 degree out-of-phase relationship with each other;

a first director assembly extending between said first dipole antenna and said second dipole antenna and a second director assembly extended between said first dipole antenna and said second dipole antenna.

2. A device as in claim 1, wherein a Wilkinson divider is connected to said dipole antennas between said balun transformers.

3. An antenna structure as in claim 2, wherein a first of said dipole antennas includes a first outer edge at one end and a second outer edge at an opposing end;

a second of said dipole antennas includes a first outer edge at one end opposite a second outer edge at a second end;

and said first director assembly extends between said first outer edge of said fist dipole antenna and said first outer edge of said second dipole antenna, and said second director assembly extends between said second outer edge of said first dipole antenna and said second outer edge of said second dipole antenna.

4. An antenna structure as in claim 1, wherein said dipole antenna elements each include two dipole radiators elements and said first director assembly extends from a radiator element of said first dipole antenna to a first radiator of said second dipole antenna, and said second director assembly extends from a second radiator element of said first dipole antenna to a second radiator of said second dipole antenna.

5. An antenna structure as in claim 1, wherein each of said director assemblies includes two directors.

6. An antenna structure as in claim 1, wherein a resistor connects said balun transformers.

7. A device as in claim 5, wherein a Wilkinson divider includes quarter-wave coaxial cables connects to each of the balun transformers.

8. An antenna structure as in claim 7, wherein said coaxial cables of said Wilkinson divider join in a single third coaxial cable.

9. An antenna structure as in claim 1, wherein a Wilkinson divider includes quarter-wave coaxial cables connects to each of the balun transformers.

10. An antenna structure as in claim 1, wherein said balun transformers include two pairs of central sections, each pair connected one of said dipole antennas, each of said dipoles forming an arrowhead shape with one pair of said central sections.

11. An antenna structure as in claim 10, wherein said central sections in each balun transformer include metal forming an H-shape with spaces at extremes, each of said dipole antennas including a pair of radiating elements; each of said central sections being formed on a face of said dielectric board and connected to said radiating elements.

12. An antenna structure as in claim 11, wherein each of said balun transformers includes a U shaped element having conductive arms on the face of the dielectric board away from the central sections and located on face of the board opposite the central sections, said U-shaped elements being conductive and isolated from each other.

13. An antenna structure as in claim 12, wherein said U shaped elements together form a clockwise and then counterclockwise path so as to form a modified S shape.

14. An antenna structure as in claim 11, wherein said U-shaped elements are narrower in width than the central sections of said balun transformers.

15. An antenna structure as in claim 10, wherein a first of said dipole antennas includes a first outer edge at one end and a second outer end at an opposing end;

a second of said dipole antennas includes a first outer edge at one extremity opposite a second outer edge at a second extremity;

and said first director assembly extends between said first outer edge of said first dipole antenna and said first outer edge of said second dole antenna;

and said second director assembly extends between said second outer edge of said first dipole antenna and said second outer edge of said second dipole antenna.

16. An antenna structure as in claim 1, wherein said board includes the dipole antennas on one face and two pairs of tabs on a second face, each pair of tabs being connected to a dipole antenna.

17. An antenna structure as in claim 1, wherein a first of said dipole antennas includes a first outer edge at one end and a second outer edge at an opposing end;

a second of said dipole antennas includes a first outer edge at one end opposite a second outer edge at a second end;

said first director assembly extends between said first outer edge of said first dipole antenna and said first outer edge of said second dipole antenna; and said second director assembly extends between said second outer edge of said first dipole antenna and said second outer edge of said second dipole antenna.

18. An antenna structure, comprising:

a blade section extending, and a T-Top housing supported by said blade section;

said T-Top including:

a dielectric board having two faces;

two bent dipole antennas placed back-to-back on one face of said dielectric board;

two balun transformers on the faces of said board each connected to one of said dipole antennas, and in 180 out-of-phase relationship with each other;

a first director assembly extending between said first dipole and said second pole, and a second director assembly said first dipole and said second pole.

19. An antenna structure as in claim 18, wherein said blade section includes a wide-band monopole.

20. An antenna structure as in claim 19, wherein said monopole is tuned to two frequency bands.

21. An antenna structure as in claim 20, wherein said monopole includes a quarter-wave stub.

22. An antenna structure as in claim 21, wherein said blade section includes a monopole, said monopole and said coaxial cable being placed for maximum decoupling between each other.

23. An antenna structure as in claim 19, wherein said monopole is of the folded type.

24. An antenna structure as in claim 18, wherein said dipole antennas are connected to a coaxial cable.

25. An antenna structure as in claim 24, wherein said coaxial cable includes a Wilkinson divider.

26. An antenna structure as in claim 18, wherein a first of said dipole antennas includes a first outer edge at one end and a second outer edge at an opposing end;

a second of said dipole antennas includes a first outer edge at one end opposite a second outer edge at a second end;

and said first director assembly extends between said first outer edge of said first dipole antenna and said first outer edge of said second dipole antenna;

and said second director assembly extends between said second outer edge of said first dipole antenna and said second outer edge of said second dipole antenna.

* * * * *

UNITED STATES PATENT AND TRADEMARK OFFICE

CERTIFICATE OF CORRECTION

PATENT NO. : 6,249,260 B1 
DATED : June 19, 2001
INVENTOR(S) : David J. Holloway It is certified that error appears in the above-identified patent and that said Letters Patent is hereby corrected as shown below:

Column 6,
Line 32, now reading, "out … other" should read:
-- "180 degree out-of-phase relationship with each other;" --
Line 34, now reading, "dipole … director" should read:
-- "dipole antenna and said second dipole antenna, and a second director" --
Line 35, now reading, "assembly … pole" should read:
-- "assembly extending between said first dipole antenna and said dipole antenna." --

Signed and Sealed this

Sixteenth Day of July, 2002

*Attest:*

*Attesting Officer*

JAMES E. ROGAN
*Director of the United States Patent and Trademark Office*